United States Patent [19]

Martin

[11] Patent Number: 4,592,578

[45] Date of Patent: Jun. 3, 1986

[54] LOCKABLE GATE LATCH

[76] Inventor: Herman R. Martin, 3536 Bernice Rd., Lansing, Ill. 60438

[21] Appl. No.: 640,922

[22] Filed: Aug. 14, 1984

[51] Int. Cl.[4] ..... E05C 1/12

[52] U.S. Cl. ..... 292/40; 70/14; 292/42; 292/148; 292/DIG. 13

[58] Field of Search ..... 292/40, DIG. 13, 42, 292/148, 151, 154, 292; 70/14

[56] References Cited

U.S. PATENT DOCUMENTS

| | | | |
|---|---|---|---|
| 918,316 | 4/1909 | Harris | 292/148 X |
| 1,008,220 | 11/1911 | Tullis | 292/299 |
| 1,177,487 | 3/1916 | Clements | 292/40 |
| 2,545,038 | 3/1951 | Kingdon | 292/299 |
| 2,609,223 | 9/1952 | Adams | 292/299 |
| 2,974,987 | 3/1961 | O'Brien | 292/148 |
| 3,599,453 | 8/1971 | Bauernfeind | 292/148 X |
| 3,938,836 | 2/1976 | Smith | 292/148 |
| 4,291,908 | 9/1981 | Gittins, Sr. | 292/299 |
| 4,369,993 | 1/1983 | Rodriguez | 292/148 |

*Primary Examiner*—Gary L. Smith
*Assistant Examiner*—Lloyd A. Gall

[57] ABSTRACT

A positive gate latch having a striker bar and two vertical catch members held in place by two sleeves secured to a base. When the catch members are down, the striker bar (often referred to as a gate tongue) cannot move in either direction. The catch members are attached to an operating bar, allowing passage when activated from either direction. The gate latch may be locked in three separate positions, allowing passage in only one direction or may be locked allowing no passage in either direction. The latch is designed primarily for use on tubular structures, such as chain link fence.

2 Claims, 6 Drawing Figures

LOCKABLE GATE LATCH

FIELD OF THE INVENTION

The present invention is directed to an improved gate latch and is especially concerned with an improvement in a bi-directional self-latching gate latch.

BACKGROUND OF THE INVENTION

Gate latches have been in common use for untold years. Such latches come in various functional types. Those that allow the gate to swing only in, those that allow the gate to swing only out and those that allow it to swing in either direction. Latches may be operable to open the gate from one or the other or both sides.

Most desirable in the modern gate latch is an automatic latching. That is, it should positively latch upon the gate swinging into its closed or shut position. It is also highly desirable in a gate latch that provisions be made for locking the gate and latch. This is especially advantageous and may often be required under local law, for example in gates helping to enclose outdoor swimming pools or other areas where access by children could be dangerous.

One example of a bi-directional gate latch is U.S. Pat. No. 1,177,487 issued to J. A. Clements in 1916. That latch is automatic and bi-directional. It may not, however, be locked. It is also of the type, shared by many gate latches, which may be opened by an intelligent dog or other pet or by a small child. Further, latches such as the Clements latch, are complex and difficult to manufacture and install and would be expensive to manufacture and difficult to mount.

The present invention provides a gate latch that is automatic and lockable and which overcomes one or more of the disadvantages of prior latches and yet achieves many of the desired features for gate latches. The gate latch of the present invention further may be easily and economically manufactured, installed and used.

SUMMARY OF THE INVENTION

A gate latch constructed in accordance with the present invention comprises a catch assembly including a base having means for mounting it to one or the other of a gate or a gate post. As an example, conventional "C" clamps may be used for such mounting. The base has mounted to it a pair of catch members, each of which is mounted for vertical limited movement between a home position and an open position. The catch members define between them, when in their home positions, a gap for receiving the strike. A strike assembly is also provided with means for mounting it to the other one of the post or gate. The strike assembly includes a strike sized and shaped to, when strike and catch assemblies are properly installed and the gate is closed, move upward one or the other of the catch members and to fit in and be releasably captivated in the gap. A latch handle is connected to each of the catch members and may be manually operated to move either or both of them from their home position to their open position to release the strike. Further provided on the base are means for receiving a locking member such that when inserted it prevents the movement of the catch members.

In accordance with an additional feature of this invention, the base and each catch member defines means for receiving a locking member for substantially locking one or both of the catch members in their home positions. This allows the gate latch to be either one that allows the gate when unlatched to swing only in, or only out or both.

In accordance with another feature of the invention, a simple locking member is provided such that both catch members are secured in their home positions and a padlock may be used to more securely lock the gate with the padlock position selectively to the inside or the outside of the gate.

The invention, together with the advantages thereof, may best be understood by reference to the following description taken in connection with the accompanying drawings, in the several figures of which, like reference numerals identify like elements.

DESCRIPTION OF THE PREFERRED EMBODIMENT

Figure 1:
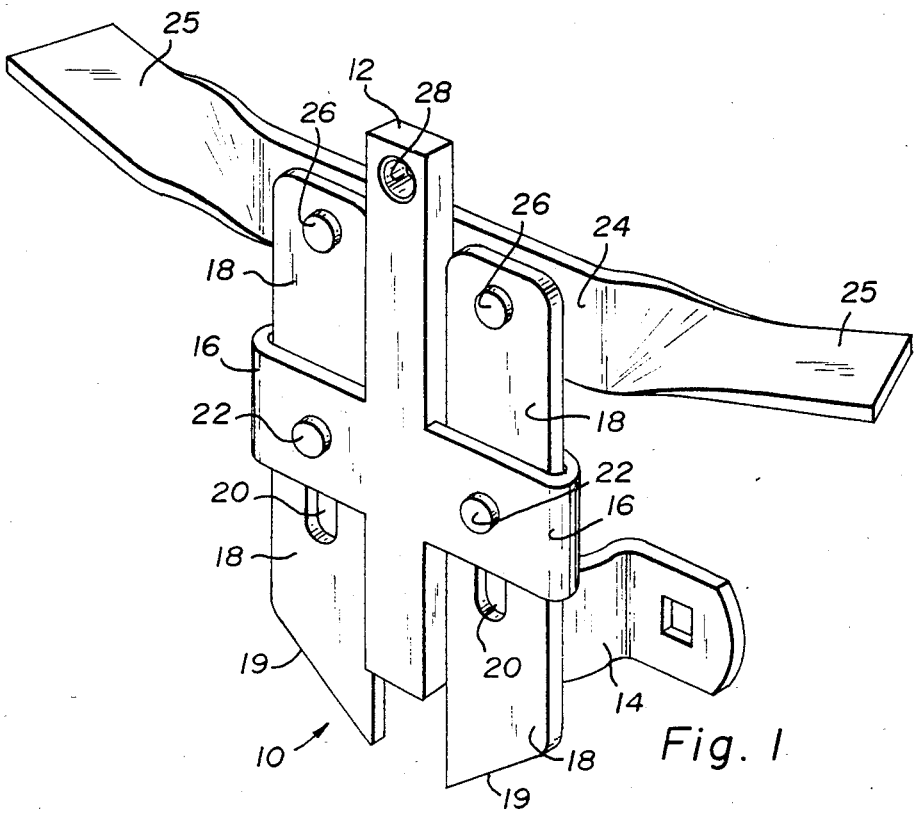
FIG. 1 is a perspective view of a catch assembly constructed in accordance with the present invention.

Referring to FIG. 1, there is depicted a catch assembly 10 constructed in accordance with the present invention. The catch assembly 10 includes a base 12 having means, a conventional "C" clamp 14, for mounting it to a gate post or gate.

The base 12 has a pair of sleeves 16 projecting on both sides for receiving in a loose fit a pair of vertically arranged catch plate members 18. The catch members 18 have a central vertically oriented slot 20. A rivet 22 is provided through each of the sleeves 16 and through the slot 20. The rivet 22 is received in the slot 20 in a loose fit and serves as a guide member for the catch member 18. The catch members 18 are thus held parallel to each other in the sleeves 16 by the rivet 22 acting as a guide member such that they can move vertically upward from a home position in which they are shown in FIG. 1 for a limited distance. A handle 24 spans across the top of the catch members 18 and is pivotally secured to each of them by rivet 26.

The base 12 is provided with an opening or hole 28 through its upper portion. The opening 28 is just above the home position of the handle 24, as better shown in FIG. 2. As can be seen in that figure, the range of movement of one catch member 18 is between the position shown in solid lines and that depicted in phantom lines. The bottom surfaces 19 of the catch members 18 are formed at an angle so as to allow a strike 30 to drive either one of them upward as it moves horizontally from either side of the assembly 10. The catch members 18 are mounted in a spaced apart array with a gap 32 between them when they are both in their home positions (solid lines of FIG. 2) into which the strike 30 may easily fit and be held by the catch members 18. The loose fit of the catch members and handle 24 allows gravity to pull each of the catch members 18 back to its home position as soon as the strike 30 enters the gap and after release of the handle by the user. The holes formed in the catch members 18 for receiving the rivets 26 are preferably made slightly elongated in the horizontal direction to accomodate the increased distance between the rivets from the position shown in solid lines in FIG. 2 to the moved position shown in phantom lines in that figure.

Figure 3:
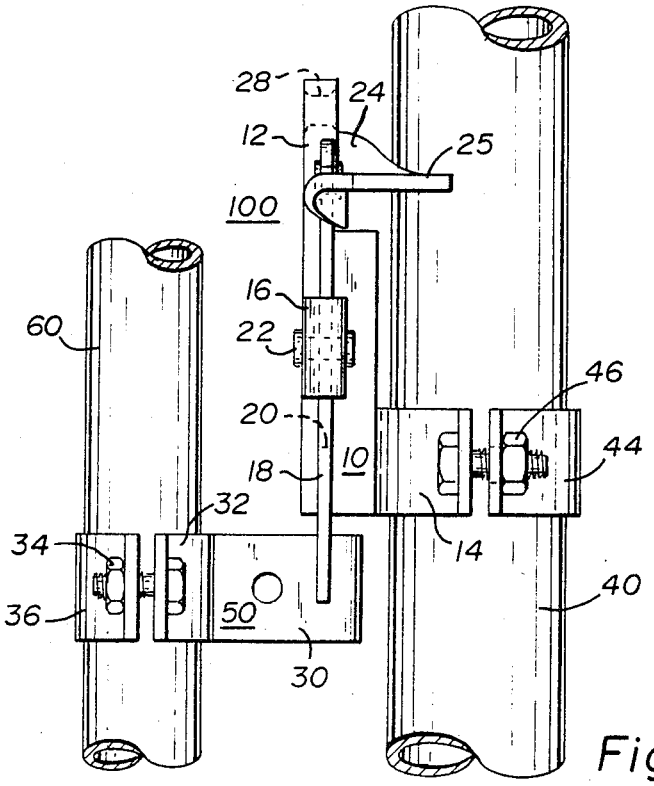
FIG. 3 is a side elevational view of the assembly of FIGS. 1 and 2 mounted on a fragmentally depicted gate.

Installed, as shown in FIG. 3, the full locking gate latch 100 preferably has the assembly 10 mounted to a fence post 40 by means of "C" clamps 14 and 44 and nuts and bolts 46. (A similar nut and bolt arrangement, [FIGS. 3 and 5] is provided on the other side of the "C" clamps 14 and 44.) The strike assembly 50 comprises the strike 30 secured, as by welding, to means for affixing it to the frame of a gate 60. Such means are in this preferred embodiment the "C" clamp 32 which is secured by nuts and bolts 34 to a second "C" clamp 36 such that both clamps 32, 36 are about an outer vertical member of the gate 60.

Figure 4:
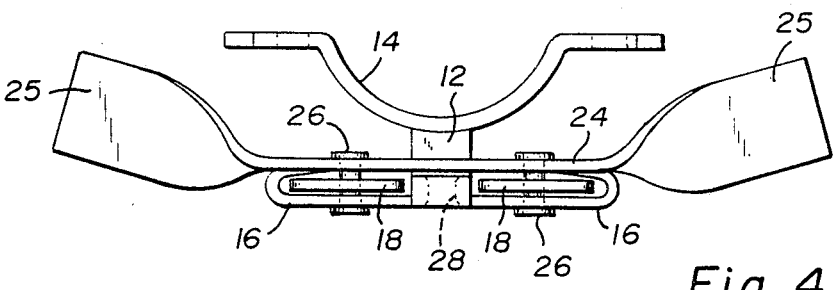
FIG. 4 is a top view of a portion of the assembly of FIGS. 1–3.

As shown best in FIG. 4, the handle 24 is preferably formed of a rectilinear elongated flat piece of metal and lies in a vertical plane with its ends 25 turned to lie in a horizontal plane. These ends 25 provide a good thumb or finger lifting surface and are preferably bent back toward the fence post so as to present a minimum obstruction to someone passing through the gate. As also indicated in FIG. 4 the fit between the catch member 18 and sleeves 16 is loose so as to allow water, ice, sleet, etc., to easily fall or drain through and not bind up the catch member 18.

Figure 2:
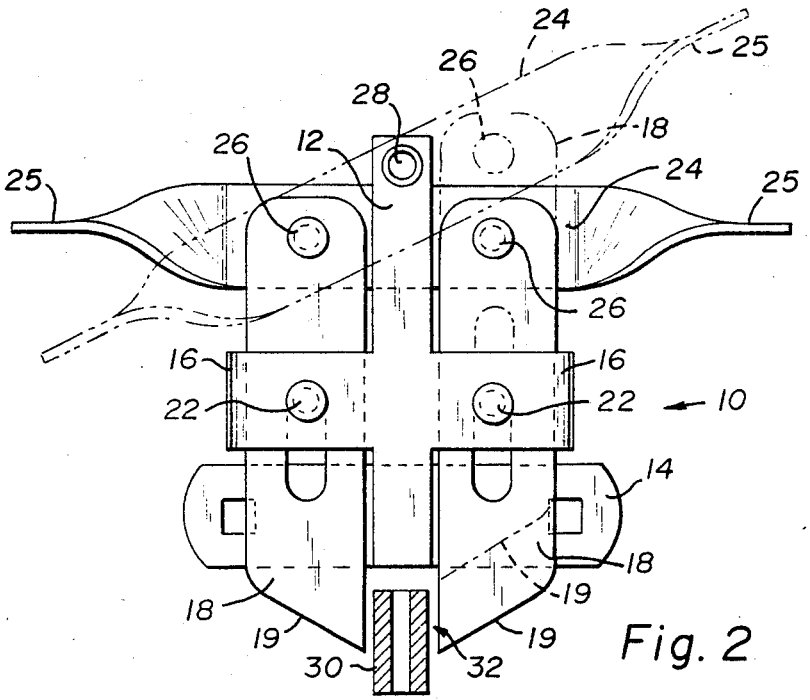
FIG. 2 is an elevational view of the assembly of FIG. 1, with a strike shown in section in one of its operational positions and with moved parts shown in phantom lines.
Figure 5:
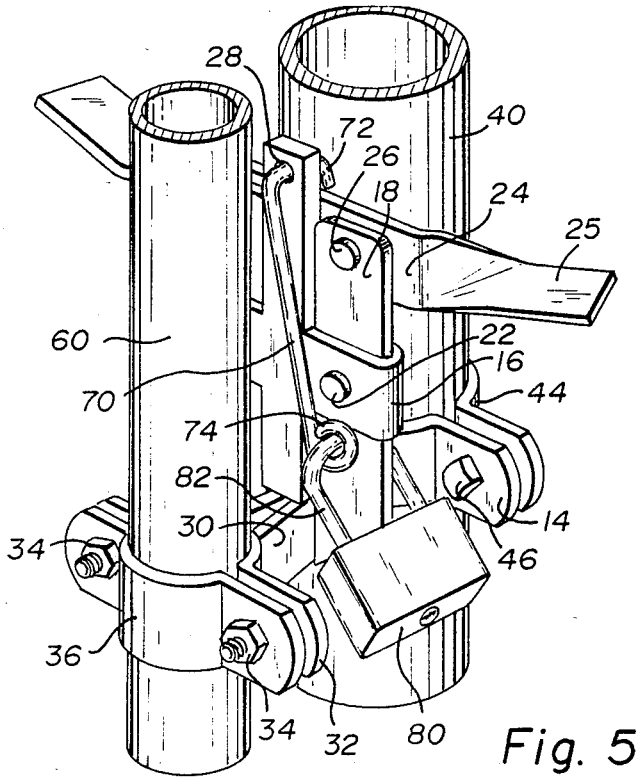
FIG. 5 is a perspective view of the assembly of FIG. 1 and strike assembly, mounted as in FIG. 3, with a locking member and padlock installed.

Referring to FIG. 5, there is depicted the catch assembly as in FIG. 1 installed as in FIG. 2 and locked by means of a special locking member 70 and padlock 80. The member 70 comprises a rod with a hook end 72 sized to just fit through the hole 28 and overlay and overlap on the other side of the handle member 24. When so installed it prevents the handle 24 and the catch members 18 from leaving their home positions. The lock member 70 is sized so as to extend to the exposed area of the slot 20 which extends below the sleeve 16. The slot 20 is sized so as to expose an opening large enough to receive the shackle 82 of the padlock 80 and the member 70 includes an eye 74 to similarly receive the shackle 82. Note should be made of the fact that this arrangement makes it easy to open the gate from one side but difficult to reach the padlock from the other side. There are many applications where this result is desired, for example, to prevent attempted picking of the padlock from the outside of the fence and gate. Alternatively, the padlock could be passed through the hole 28 directly in which case it would be equally accessible from either side. The member 70, (or a similar pin) can also be used through the hole 28 without a lock 80 when it is desired to just lock the latch against pets or small children who could not easily remove it.

Figure 6:
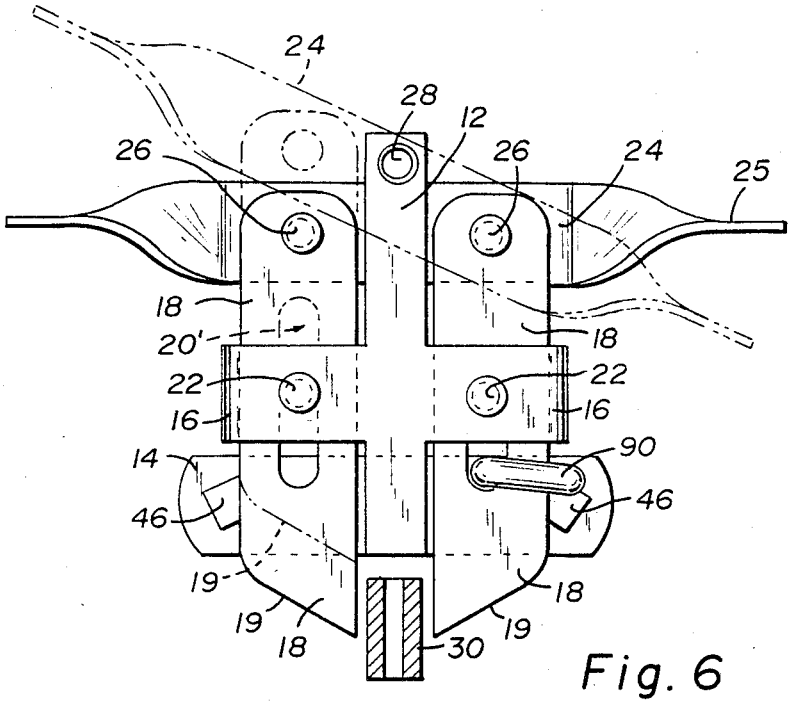
FIG. 6 is a view similar to that of FIG. 2 showing the assembly of FIGS. 1–5 converted to being a one-way opening gate latch.

In FIG. 6 is illustrated the manner of adapting the latch 100 so as to have the gate open in only one direction (in or out). This is done by providing a ring 90 or other stop member that like the shackle 82 passes through the exposed opening of one slot 20 below the sleeve 16. In this case only the opposite catch member 18 can be raised (from either side of the gate by using the handle 24) as shown in phantom lines. With this arrangement the gate can be locked by a pin or shackle through either the hole 28 or the slot 20 of the movable catch member 18.

It should be noted that a pin or ring such as the ring 90 can be positioned in the exposed slot 20 of either or both catch member 18 when it is in its open position (i.e. in the opening indicated by 20′ in FIG. 6) should it be desired to temporarily keep the latch assembly 100 from latching.

It should now be apparent that a locking latch assembly 100 has been described that is quite versatile. The assembly 100 may serve a two way opening gate or convert a gate so as to open only "in" or only "out". The latch assembly may be locked by a pin or padlock such that the padlock is readily accessible to both sides of the gate or to only one or the other side by using the locking member 70.

The latch assembly 100 is easily and economically manufactured. As depicted, the sleeve 16 and strike member 30 are identical in configuration. Similarly, the catch members 18 are of identical configuration. This yields benefits as it reduces the number of different configurated parts that are necessary to make. These parts, as well as the handle 24 are readily cut or stamped from flat steel and easily formed by simple tools and jigs. Further, the unit 30–32 is a pre-existing part used in the commercially available STA-KLOS gate closer marketed by Ingot Products, Inc. Thus a further advantage of the current invention is that it can employ pre-existing parts and thus reduce the number of separate new parts necessary to be manufactured and inventoried.

The assembly 10 has only three moving parts which are secured to the base 12 and each other by four simple rivets. The mounting means for the strike 30 and base 12 may be conventional "C" clamps as are commonly used for gate and fence hardware. The locking member 70 and ring 90 may be formed of wire stock.

A prototype of the invention was constructed and tested and demonstrated to work well.

For purposes of illustration and not for purposes of limitation the following presently preferred dimensions and materials are specified. Of course, as is well known to those in this art, many other sizes and materials as well as variations in arrangement can be employed and, indeed, the present inventor may, for reasons of economy and other reasons decide in the future to vary from these particulars. However, as presently contemplated the preferred embodiment would employ catch members 18, handle 24, sleeves 16 and strike 30 made of one-eighths inch thick flat steel. The sleeves and strike are preferred to be about 1 inch high and one and seven-sixteenths inch wide with nine thirty seconds inch diameter holes. The catch members 18 would be about four and one half inches in height one and one quarter inches wide with slot 20 about three-eighths inch by one and three-sixteenths inch in overall size. Its hole for receiving the rivet 26 is preferably about thirteen thirty-seconds by eleven thirty-seconds inches in overall size. Its bottom surface 19 is preferably formed at an angle of 60 degrees to the vertical. The handle is preferably about seven and three-eighths inches long and also formed of one inch wide by one-eighth inch stock with one-quarter inch diameter holes for receiving rivets 26. The base 12 is preferably formed of three-fourths by five-eighth inch steel stock with hole 28 being nine thirty-seconds inches in diameter and counter sunk. The locking member 70 was formed of one-quarter inch thick steel rod and was about three and five-eighth inches in overall length with its eyelet having a three-eighth inch inside diameter. The rivets 26 are preferably flat head shoulder rivets $9/32 \times \frac{1}{4}$ inch, CRS semi-tubular and the rivets 22 are preferably 5/16 inch CRS semi-tubular.

This arrangement produces a strong gate latch that is lockable and versatile of an overall size that is convenient to install and use. The parts shown constitute a kit from which the professional as well as the do-it-yourself can easily and quickly assemble and install a lockable gate latch.

While only one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A lockable gate latch assembly for use on a gate that closes to a gate post comprising:

a strike;

means for mounting the strike to one of the gate or gate post;

a catch assembly comprising:

means for mounting the catch assembly to the other of the gate or gate post;

a pair of catch members;

means for mounting the catch members so as to be movable from a home position, to which they tend to return when moved, to an open position, said members when in the home position defining a gap for, when operationally installed on a gate, receiving the strike and preventing its exit; and means for selectively locking one or both of the catch members so as to prevent its movement to the open position said catch assembly includes a handle member operationally connected to said catch members for moving one or the other of said catch members from its home position to its open position, if not locked against such movement, in response to manual operation of the handle member; said catch assembly mounting means includes a base, and said base is provided with means for receiving a locking member such that the locking member when received therein restrains said handle member as well as the operationally connected catch members from substantial movement so as to prevent each catch member from moving to its open position; each of said catch members is mounted for generally vertical limited movement, returns to its home position by gravity, and includes an opening defined through it into which a shackle may be inserted; said assembly includes a locking member that is sized and shaped so as to be able to enter said receiving means of said base and includes means for receiving said shackle mounted such that said locking member may enter said receiving means of said base and have said shackle of a padlock received in its shackle receiving means and also passed through the opening through one of said catch members; and said catch members are of elongated metal plate configuration and are vertically mounted with a base fit into sleeves which are secured to said base, said catch members each having a vertical slot formed in them and being held in place by means of a guide member affixed to the sleeve which passes through the slot, said slot having an area exposed below said sleeve when the catch member is in its home position and that exposed slot area also serving as the opening for receiving said shackle.

2. A catch assembly for a lockable gate latch comprising:

means for mounting the catch assembly;

a pair of catch members;

means for mounting the catch members, so as to be movable from a home position to which they tend to return to an open position, said members when in the home position defining a gap for receiving a strike and preventing its exit when operationally installed on a gate, and means for selectively locking one or both of the catch members so as to prevent its movement to the open position said catch assembly includes a handle member operationally connected to said catch members for moving one or the other of said catch members from the home position to their open position, if not locked against such movement, in respose to manual operation of the handle member; said catch assembly mounting means includes a base, and said base is provided with means for receiving a locking member such that the locking member when received therein restrains said handle member as well as the operationally connected catch members from substantial movement so as to prevent each catch member from moving to its open position; said catch members are mounted for generally vertical limited movement and return to the home position by gravity, and include an opening into which a shackle may be inserted; said assembly includes a locking member that is sized and shaped so as to be able to enter said receiving means of said base and includes means for receiving said shackle mounted such that said locking member may enter said receiving means of said base and have said shackle of a padlock received in its shackle receiving means and also passed through the opening through one of said catch members; and said catch members are each of elongated flat plate configuration and are vertically mounted with a loose fit into sleeves which are secured to said base, said sleeves mounting said catch members so that they are in a spaced apart adjacent array in approximately the same vertical plane, said catch members each having a vertical slot and are held in place by means of a guide member affixed to the sleeve which passes through the slot, said slot having an area exposed below said sleeve when the catch member is in its home position and that exposed slot area also serves as the opening for receiving said shackle.

* * * * *